United States Patent [19]

Haskins

[11] 4,319,107

[45] Mar. 9, 1982

[54] ENCLOSED MODULAR SWITCH

[75] Inventor: Steve W. Haskins, Corinth, Miss.

[73] Assignee: Northern Telecom, Inc., Ottawa, Canada

[21] Appl. No.: 171,175

[22] Filed: Jul. 22, 1980

[51] Int. Cl.[3] ..... H01H 9/02

[52] U.S. Cl. ..... 200/303; 200/307; 200/339

[58] Field of Search ..... 200/1 R, 1 A, 1 TK, 200/6 R, 6 B, 6 BA, 6 BB, 245, 246, 247, 248, 249, 250, 283, 284, 302, 303, 307, 325, 339

[56] References Cited

U.S. PATENT DOCUMENTS

| | | | |
|---|---|---|---|
| 3,221,131 | 11/1965 | Bury | 200/307 |
| 3,555,229 | 1/1971 | Britton et al. | 200/249 |
| 3,971,904 | 7/1976 | Ward | 200/303 X |
| 4,024,362 | 5/1977 | Morgan et al. | 200/339 X |
| 4,144,430 | 3/1979 | Coldren et al. | 200/246 X |
| 4,179,593 | 12/1979 | Tsunefuji | 200/325 X |

*Primary Examiner*—J. V. Truhe
*Assistant Examiner*—W. E. Duncanson, Jr.
*Attorney, Agent, or Firm*—Schwartz, Jeffery, Schwaab, Mack, Blumenthal & Koch

[57] ABSTRACT

A modular switch, which can be used in telecommunications systems, provides an enclosed environment and, from a particular selection of spring cantilever contact members, a normally made, a normally open and transfer function can be provided. By shaping the body of the switch a plurality of switches can be attached together.

10 Claims, 7 Drawing Figures

ENCLOSED MODULAR SWITCH

BACKGROUND OF THE INVENTION

This invention generally relates to enclosed modular switches, and more particularly, though not exclusively, to modular switches for use in telephones and other telecommunication apparatus.

Many switches in telephone sets and similar apparatus, while housed within the casing of the apparatus, are necessarily subject to ingress of dirt and other foreign matter because of the need of an actuating or operating member to extend through the casing. A typical example is a hook switch for a telephone set. In other uses, the switches may not be in a casing.

SUMMARY OF THE INVENTION

The present invention provides a switch which, when assembled, provides an enclosed environment for the contacts. A feature of the invention is that the particular form of switch can readily be varied, for example the same basic units or parts can provide a transfer switch; a normally closed-actuate to open switch and a normally open-actuate to close switch. Also the direction of operation can be varied and also a switch which is normally open and can be selectively closed by actuation in either direction. A further feature of the invention provides for assembly of a plurality of switches, one to another.

Broadly the invention comprises a body member open on one side and having an extension at one end within which an actuator rotates; a plurality of contacts within the body member, one of the contacts moved by the actuator; and a cover which slides on the open side to enclose the contacts.

BRIEF DESCRIPTION OF THE APPLICATION DRAWINGS

The invention will be readily understood by the following description of certain embodiments, by way of example, in conjunction with the accompanying drawings, in which.

DETAILED DESCRIPTION OF THE PREFERRED EMBODIMENTS

Figure 1:
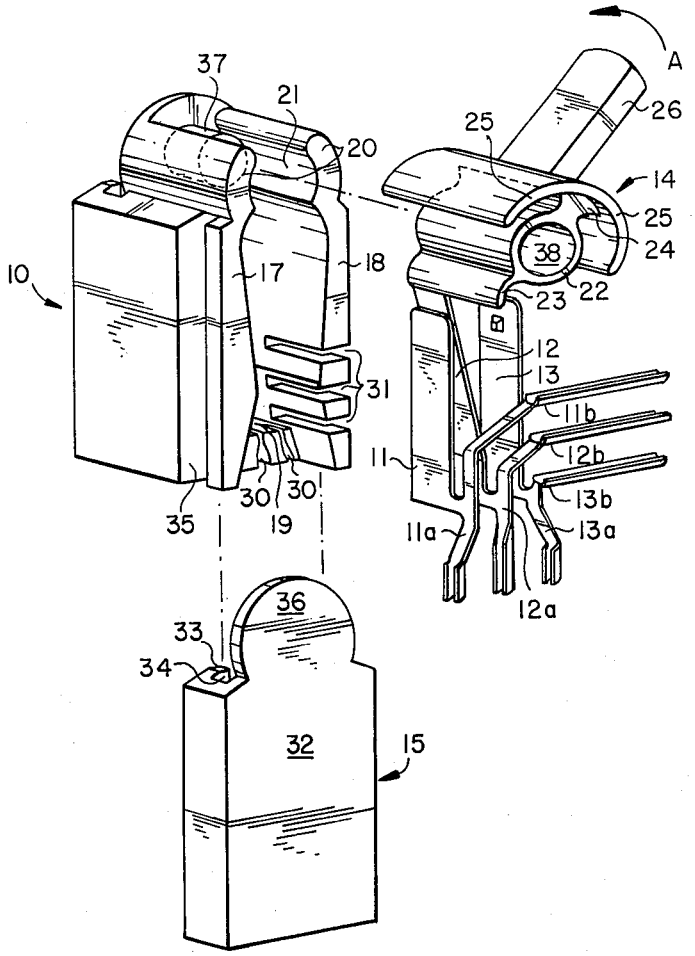
FIG. 1 is an exploded perspective view of the parts of one form of switch.

As illustrated in FIG. 1, a switch comprises a body member, generally indicated at 10, a plurality of cantilever spring contacts 11, 12 and 13, an actuator, generally indicated at 14, rotatably mounted in one end of the body member 10, and a cover, generally indicated at 15. The body member 10 is hollow, having a back web 16, seen in FIG. 2, side members 17 and 18, a base 19 and arcuate extensions 20 at one end, conveniently referred to as the top end, the arcuate extensions defining a bore 21.

Actuator 14 has a cylindrical body portion 22 which is a close rotational fit in the bore 21, a downward extending contact lever or rib 23 and an upward extending rib 24 which carries an arcuate shroud 25. Shroud 25 is a close sliding fit on the outside of the arcuate extensions 20. An actuating lever 26 extends up from the shroud 25.

The spring contacts 11, 12 and 13 each have two terminal portion extensions 11*a*, 11*b*; 12*a*, 12*b*; 13*a*, 13*b*; respectively. One set of extensions 11*a*, 12*a* and 13*a* extend through slots 30 in the base 19 and the other extensions, 11*b*, 12*b* and 13*b* extend through slots 31 in the side member 18.

The cover 15 has a main web member 32 with ribs 33 on each side defining grooves 34. On the forward edges of the side members 17 and 18 are grooves 35, and the arrangement is such that the cover is slid on, the ribs 33 slide in the grooves 35 and the front edges of the side members slide in grooves 34. The web 32 is extended at the top, at 36, to conform with the arcuate extensions 20. The top of the back web 16 of the body member is also extended to close the rear end of the bore 21. A spigot 37 can be provided to mate with a bore 38 in the actuator body portion 22.

The contacts for a switch normally comprise three, selected from a set of four. Thus there are two straight contacts 11 and 13 and one bent contact 12.

In the example illustrated, the center contact 12 is bent to the left biased into normal contact with contact 11. The actuator has the contact lever 23 to the left of the center contact and actuation is by counterclockwise movement of the actuator 14, as shown by arrow A. The alternative form of center contact is one which is bent to the right, normally in contact with contact 13. The actuator then has reverse movement, i.e. clockwise, and this can be obtained merely by reversing the actuator 14 in the body member 10. Thus with four contact leaf formations, two straight, one biased to the right and one to the left, it is possible to select either way of actuation.

Further, instead of being a transfer switch, as in FIG. 1, by selectively omitting one of the outside contacts 11 or 13, either a normally closed-actuated to close switch can be provided, with either direction of rotation of the actuator.

Figure 2:
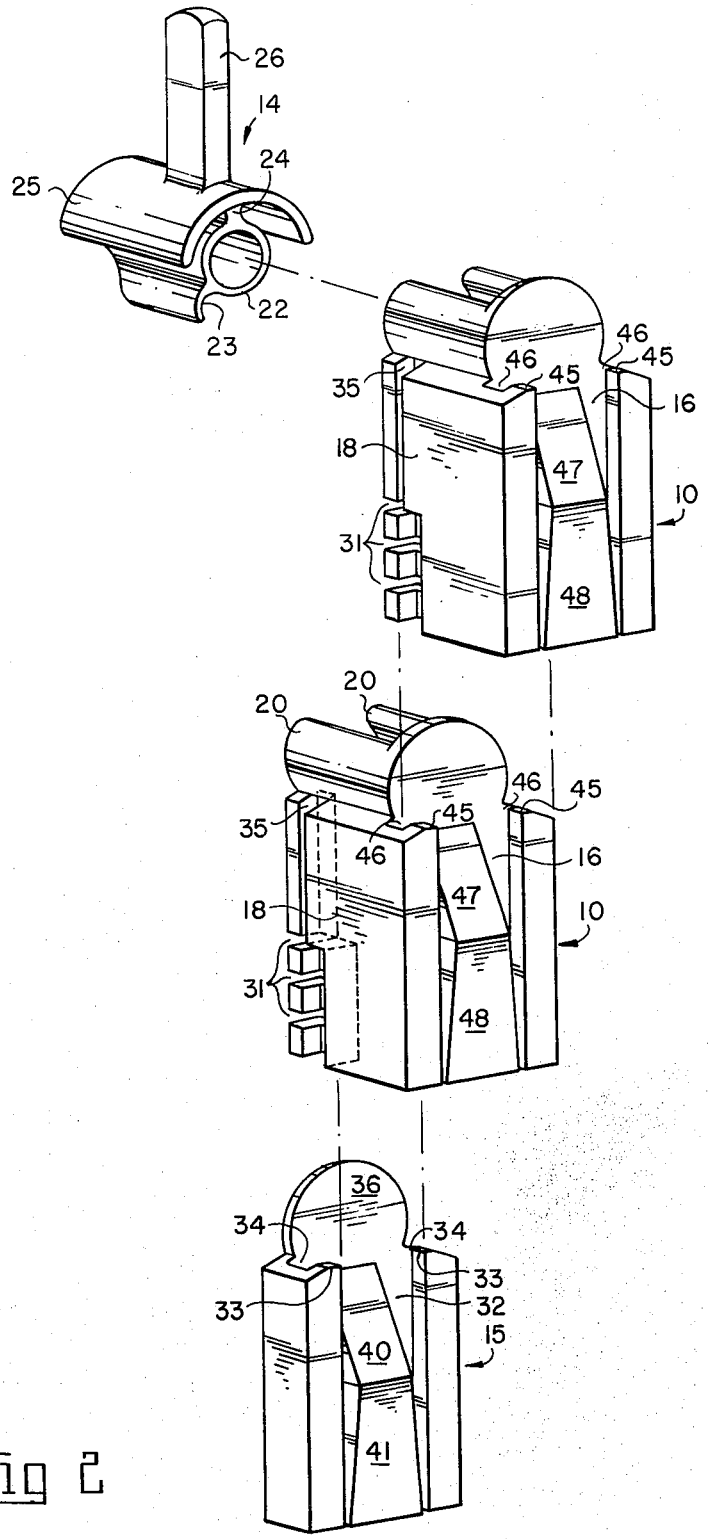
FIG. 2 is an exploded perspective view illustrating the modular concept, with two body parts positioned for assembling together.

The inner side of the cover 15 is seen in FIG. 2. On the inner surface of the web 32 is a ramp 40 and a wide rib 41. Ramp 40 and rib 41 act to ensure that the contacts are pushed into position. From FIG. 2 it is also seen how the rear of the back web 16 of the body member 10 is formed to reproduce the form of the cover 15. Ribs 45 define grooves 46 and a ramp 47 and rib 48 are provided. By this means it is possible to attach the rear of one switch module to the front of another by relative sliding, as in assembling a cover to a body member. A separate cover is only required for the front module, the back of one module acting as a cover for the next module.

Figure 3:
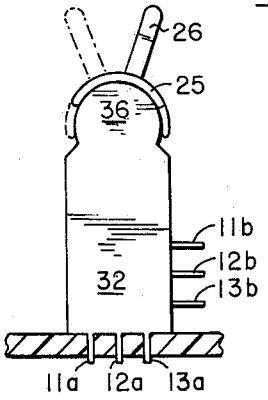
FIGS. 3 and 4 illustrate alternate mounting arrangements of the switch of FIG. 1.
Figure 4:
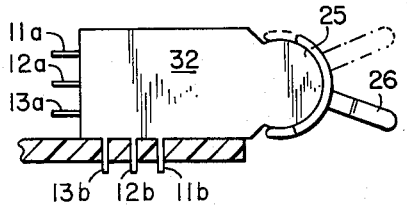

FIGS. 3 and 4 illustrate alternate mountings of a switch on, for example, a circuit board. The switch can be mounted on its base or on its side.

Figure 5:
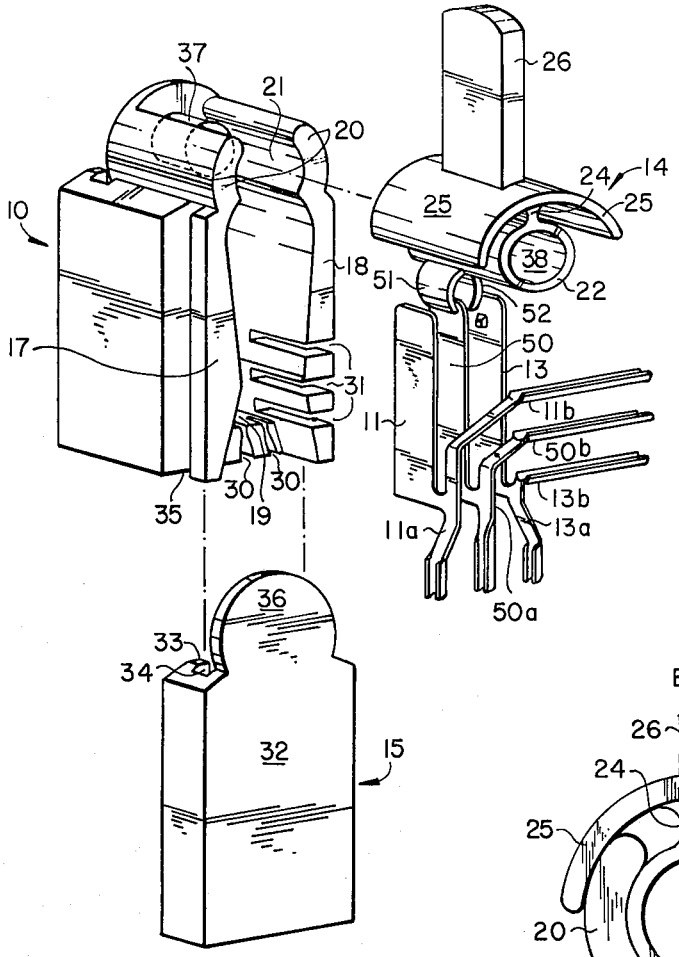
FIG. 5 is an exploded perspective view similar to that of FIG. 1, illustrating an alternative form of switch.
Figure 6:
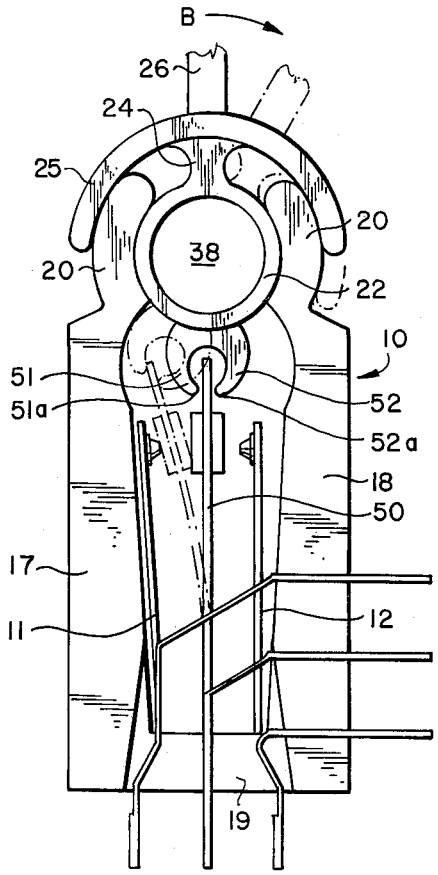
FIG. 6 is a front view on the switch of FIG. 5, with cover removed.

FIG. 5 is a perspective exploded view and FIG. 6 is a front view of an alternative form of enclosed switch in which a center cantilever spring contact is normally in a mid position and is around one way or the other to make contact with spring contacts on either side, or in an alternative arrangement, on one side or the other. The body member, and cover are the same as those in FIGS. 1 to 5, and the actuator is very similar to that in FIGS. 1 to 5 and the same reference numerals are used for the same details, as far as applicable. The switch is seen in perspective in FIG. 7, which also illustrates the modular concept and the assembly of a plurality of switches together.

Figure 7:
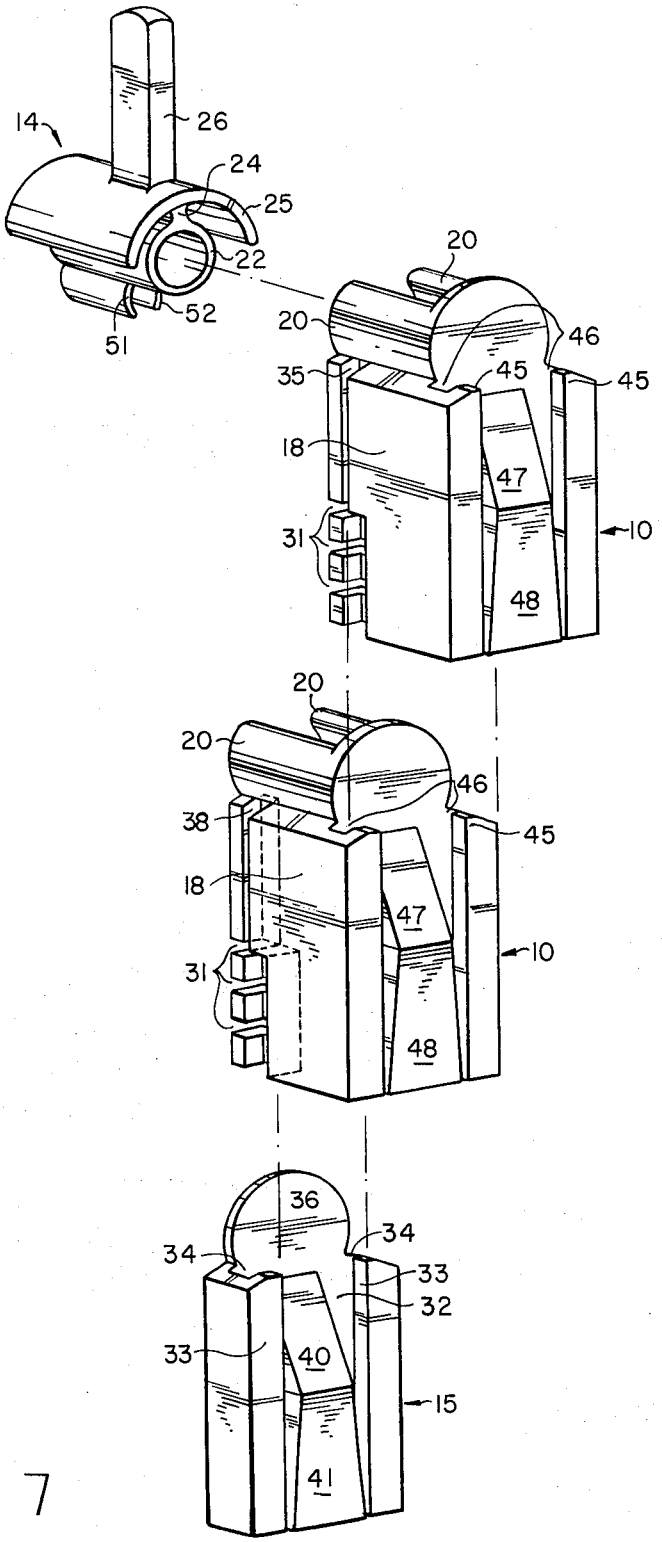
FIG. 7 is an exploded perspective view, similar to that of FIG. 4, of switches as in FIGS. 5 and 6.

Thus, in FIGS. 5, 6 and 7, there is the body member 10, cover 15, cantilever spring contact members 11 and 13 plus a straight center cantilever spring contact member 50. The body member has side members 17 and 18 and base 19, arcuate extensions 20 defining bore 21 and slots 30 and 31 in base and side member 18 respectively.

The actuator 14 has cylindrical body portion 22, upward extending web 24, arcuate shroud 25 and actuating lever 26. The difference between actuator 14, of FIGS. 6 and 7 and the actuator 14 of FIGS. 1 to 5 is in the actuating member which moves the center spring 50. Actuator 14 in FIGS. 6 and 7 has two spaced apart downwardly extending ribs 51 and 52. Ribs 51 and 52 are arcuate, extending first away from each other and then round and towards each other, terminating in opposed ends 51*a* and 52*a*. The end of the contact member 50 lies between the ends 51*a* and 52*a*. Movement of the actuator by moving lever 26 deflects the center spring contact member one way or the other. As illustrated in FIG. 6, movement of lever 26 clockwise, in the direction of arrow B, rotates the actuator 14 and the rib 52 pushes the contact member 50 to the left into contact with contact member 11, as indicated in dotted outline. Reverse movement of the lever 26 moves the center contact member into contact with contact member 13. If only one way actuation is required, then the unused contact member, 11 or 13, can be omitted.

The cover 15, seen in FIG. 7, is of the same form as the cover 15 in FIGS. 1–6. Also, the rear of the back web 16 of the body member reproduces the form of the cover, to give interengaging ribs and grooves. A number of switch assemblies can be assembled together, as in the previous example, the back web of one body member forming the cover for the next body member.

Normally the actuator returns to its non-operative position under the spring bias of the central contact member, in both embodiments. The actuating pressure required can be varied by varying the length of rib 23, in FIGS. 1 and 2 and ribs 51 and 52 in FIGS. 6 and 7.

What is claimed is:

1. An enclosed modular switch comprising:

a first body member having a back, sides and a base forming a hollow enclosure;

arcuate extensions on said sides, concave inner surfaces of said arcuate extensions defining a bore at a top end of said body member, said bore closed at its back by said back of the first body member;

an actuator rotatably mounted at said top end of said first body member, said actuator including a cylindrical body portion rotatably mounted in said bore, an arcuate shroud spaced from said body portion, an actuating lever extending from said shroud, and a contact lever extending from said body portion into said first body member, the shroud having a close sliding fit on convex outer surfaces of said arcuate extensions;

a plurality of cantilever contacts mounted on said first body member, one of said contacts including an extension for contact by said contact lever and movement thereby;

a cover slideable onto said first body member to form a front closing member at forward edges of said sides, said cover including an extension to extend over front edges of said arcuate extensions;

said contacts including terminal portions extending from said first body member;

movement of said actuating lever rotating said cylindrical body portion, said shroud moving over said converse outer surfaces, and said contact lever moving said one of said contacts to modify a switch condition.

2. A switch as claimed in claim 1, said contacts including a center contact and at least one side contact, said center contact biased towards one of said sides of said body member.

3. A switch as claimed in claim 1, said contacts including a center contact and a side contact on each side of said center contact, said center contact biased to a make condition with one of said side contacts.

4. A switch as claimed in claim 1, said contacts each including a terminal portion extending through said base and a terminal portion extending through one side.

5. A switch as claimed in claim 1, said cover comprising an integral part of a second body member which is a portion of a further enclosed modular switch, whereby a plurality of enclosed modular switches can be joined together.

6. A switch as claimed in claim 1, said sides having grooves formed in outer surfaces, said grooves extending parallel and adjacent to forward edges of the sides, said cover including ribs on each side of a rear face, said ribs spaced from said rear face and slidable in said grooves.

7. A switch as claimed in claim 5, said first body member including ribs on each side of a rear face of the back thereof, said ribs spaced from said rear face, said sides having grooves formed in outer surfaces, said grooves extending parallel and adjacent to forward edges of the sides, said ribs on said rear face being slideable in grooves in the sides of a further like body member, and wherein said cover includes ribs slideable in said grooves in said sides.

8. A switch as claimed in claim 7, wherein said ribs of said first body member are slideably received in said grooves in the side of said further like body member and said cover is slideably received on said further like body member.

9. A switch as claimed in claim 1, said contacts including a center contact and a side contact on each side of said center contact, said center contact having a normal position spaced from said side contact, movement of said actuating lever moving said center contact into electrical contact with a selected one of the side contacts.

10. A switch as claimed in claim 1, the switch comprising one of a transfer switch, a normally closed switch and a normally open switch.

* * * * *

UNITED STATES PATENT OFFICE

CERTIFICATE OF CORRECTION

Patent No. 4,319,107 Dated March 9, 1982

Inventor(s) Steve W. HASKINS

It is certified that error appears in the above-identified patent and that said Letters Patent are hereby corrected as shown below:

On the Title page Item [73] Assignee:

Kindly delete "Ottawa, Canada".

Signed and Sealed this

First Day of June 1982

[SEAL]

Attest:

GERALD J. MOSSINGHOFF

Attesting Officer

Commissioner of Patents and Trademarks